United States Patent [19]

Takasaki et al.

[11] Patent Number: 4,517,031

[45] Date of Patent: May 14, 1985

[54] METHOD OF MANUFACTURING COLD ROLLED STEEL SHEETS FOR EXTRA DEEP DRAWING WITH AN EXCELLENT PRESS FORMABILITY

[75] Inventors: Junsuke Takasaki; Hirotake Sato; Akira Yasuda, all of Chiba, Japan

[73] Assignee: Kawasaki Steel Corporation, Kobe, Japan

[21] Appl. No.: 549,781

[22] Filed: Nov. 8, 1983

[30] Foreign Application Priority Data

Nov. 12, 1982 [JP] Japan ..... 57-197766

[51] Int. Cl.[3] ..... C21D 8/04

[52] U.S. Cl. ..... 148/12 C; 148/120

[58] Field of Search ..... 148/12 C, 12 D, 12.4, 148/36

[56] References Cited

U.S. PATENT DOCUMENTS

| | | | |
|---|---|---|---|
| 4,331,488 | 5/1982 | Sudo et al. | 148/36 |
| 4,441,936 | 4/1984 | Takahashi et al. | 148/12 C |

FOREIGN PATENT DOCUMENTS

| | | | |
|---|---|---|---|
| 1816868 | 7/1970 | Fed. Rep. of Germany . | |
| 3023723 | 1/1981 | Fed. Rep. of Germany . | |
| 104417 | 8/1979 | Japan | 148/12 C |
| 73825 | 6/1980 | Japan | 148/12 D |
| 3656 | 1/1981 | Japan | 148/36 |
| 35726 | 4/1981 | Japan | 148/12 C |
| 69358 | 6/1981 | Japan | 148/36 |
| 13123 | 1/1982 | Japan | 148/12 C |
| 2085331 | 4/1982 | United Kingdom . | |

OTHER PUBLICATIONS

JP-A-58-52,441—Sep. 22, 1983—Japan, Patent Abstracts of Japan, vol. 7, No. 139, Jun. 17, 1983.

*Primary Examiner*—Peter K. Skiff

*Attorney, Agent, or Firm*—Balogh, Osann, Kramer, Dvorak, Genova & Traub

[57] ABSTRACT

A method of manufacturing cold rolled steel sheets for extra deep drawing is disclosed, which comprises the steps of:

melting and continuously casting a steel material containing not more than 0.0060% of C, 0.01 to less than 0.10% of Mn, 0.005-0.10% of Al, Ti corresponding to Ti(%) of the following equation (1) when an effective Ti amount expressed by Ti* in the formula (1) satisfies the following inequality (2), and optionally, 0.005~0.2% in total of at least one of Cu, Ni and Cr to obtain a cast slab;

hot rolling the cast slab immediately or after the slab is heated at a temperature of 900°-1,150° C. during which a hot finishing temperature is made to not more than 780° C.;

cold rolling the hot rolled sheet in the usual manner; and recrystallization annealing the cold rolled sheet at a temperature of not less than the recrystallization temperature but not more than 1,000° C.

$$Ti^*(\%) = Ti(\%) - (48/14)N(\%) - (48/32)S(\%) \quad (1)$$

$$4.0 \times C(\%) \leqq Ti^*(\%) \leqq 0.10 \quad (2)$$

2 Claims, 3 Drawing Figures

METHOD OF MANUFACTURING COLD ROLLED STEEL SHEETS FOR EXTRA DEEP DRAWING WITH AN EXCELLENT PRESS FORMABILITY

BACKGROUND OF THE INVENTION

1. Field of the Invention

This invention relates to a method of manufacturing cold rolled steel sheets for extra deep drawing with excellent press formability and/or chemical conversion treating property.

2. Description of the Prior Art

In the manufacture of cold rolled steel sheets for use in the extra deep drawing, it has hitherto been adopted to add Ti to an extremely low carbon steel having a carbon content of 0.001–0.02% and perform the hot rolling at a temperature higher than the $Ar_3$ transformation point as disclosed in Japanese Patent Application Publication No. 44-18,066. However, in such a method, as the carbon content becomes lower, the $Ar_3$ transformation point rises, so that the hot finishing temperature (FT) must be set at not less than 880° C. Thus, in order to secure this FT, the heating temperature of the cast slab must be raised from about 1,200° C. used in the conventional low carbon steel (C≅0.02–0.04%) to a high temperature of 1,250°–1,350° C., which has the following drawbacks:

(a) The energy consumed in the heating furnace becomes considerably and uneconomically larger;

(b) Since the heating temperature becomes higher, there are caused the increase in the maintenance cost of the heating furnace, the reduction of the yield due to the increase in the amount of scale produced, the increase in the wear-out amount of the rolls, and the like;

(c) In the case that the cast slab is directly subjected to a hot rolling without passing through a reheating furnace, the slab temmperature is apt to lower in the hot rolling, so that it is difficult to maintain the hot finishing temperature of not less than $Ar_3$ transformation point and to obtain sheets of good quality.

SUMMARY OF THE INVENTION

An object of the present invention is to solve the aforementioned drawbacks of the prior art and to provide a method of economically and advantageously manufacturing cold rolled steel sheets for the extra deep drawing, which can considerably lower the heating temperature of the slab or directly apply the continuously cast slab to a hot rolling without heating.

According to a first aspect of the invention, there is the provision of a method of manufacturing cold rolled steel sheets for extra deep drawing with an excellent press formability, which comprises the steps of:

melting a steel material containing not more than 0.0060% by weight of C, 0.01 to less than 0.10% by weight of Mn, 0.005–0.10% by weight of Al and Ti corresponding to Ti (%) represented by the following equation (1) when an effective Ti amount expressed by Ti* in the equation (1) satisfies the following inequality (2);

continuously casting the resulting molten steel to produce a cast slab;

hot rolling the resulting cast slab immediately or after the slab is heated at a temperature of 900°–1,150° C., during which a hot finishing temperature is made to a temperature of not more than 780° C.;

cold rolling the resulting hot rolled sheet in the usual manner; and subjecting the resulting cold rolled sheet to a recrystallization annealing at a temperature of not less than the recrystallization temperature but not more than 1,000° C.

$$Ti^*(\%) = Ti(\%) - (48/14)N(\%) - (48/32)S(\%) \quad (1)$$

$$4.0 \times C(\%) \leqq Ti^*(\%) \leqq 0.10 \quad (2)$$

According to a second aspect of the invention, there is the provision of a method of manufacturing cold rolled steel sheets for extra deep drawing with excellent press formability and chemical conversion treating property, which comprises the steps of:

melting a steel material containing not more than 0.0060% by weight of C, 0.01–0.10% by weight of Mn, 0.005 to less than 0.10% by weight of Al, Ti corresponding to Ti(%) represented by the following equation (1) when an effective Ti amount expressed by Ti* in the equation (1) satisfies the following inequality (2) and 0.05–0.20% by weight in total of at least one element selected from Cu, Ni and Cr;

continuously casting the resulting molten steel to produce a cast slab;

hot rolling the resulting cast slab immediately or after the slab is heated at a temperature of 900°–1,150° C., during which a hot finishing temperature is made to a temperature of not more than 780° C.;

cold rolling the resulting hot rolled sheet in the usual manner; and subjecting the resulting cold rolled sheet to a recrystallization annealing at a temperature of not less than the recrystallization temperature but not more than 1,000° C.

$$Ti^*(\%) = Ti(\%) - (48/14)N(\%) - (48/32)S(\%) \quad (1)$$

$$4.0 \times C(\%) \leqq Ti^*(\%) \leqq 0.10 \quad (2)$$

BRIEF DESCRIPTION OF THE DRAWINGS

The invention will be described in detail with reference to the accompanying drawings, wherein.

DETAILED DESCRIPTION OF THE INVENTION

The invention will now be described in detail below.

The inventors have made studies in order to overcome the aforementioned problems of the prior art and found that cold rolled steel sheets having an excellent extra deep drawability can be obtained by making the C content as extremely low as not more than 0.0060% and the Mn content as low as 0.01 to less than 0.10% with respect to the composition of the steel material and by adding a small amount of Ti even when the hot finishing temperature is not more than 780° C.

According to the invention, the reason why the ingredients of the steel material are restricted to the above defined ranges is mentioned as follows.

Ti and C

The addition amount of Ti is determined from the standpoint of the intended improvement on the quality and is particularly important for the invention.

In order to obtain a good quality in the titanium-containing steel, it is necessary to add Ti in such an amount that it fixes all the amount of solid solved C in the form of TiC. The order of the production of Ti-base precipitates in the Ti-containing steel is that Ti, N and TiS are first precipitated at a high temperature of not less than 1,400° C., and then the remaining Ti is reacted with C to form TiC precipitate. Therefore, if the addition amount of Ti is too small and a part of C in the molten steel remains in the steel sheet as a solid solved C without being fixed as TiC precipitate, the $\bar{r}$ value and elongation of the steel sheet are deteriorated. Hence, Ti must be added in an amount required for precipitating all of solid solved C in the form of TiC.

The lower limit of the Ti addition amount is determined as follows.

That is, as defined in the above equation (1), the effective Ti amount for the fixation of C (shown by "Ti*" in the equation (1)) is calculated by subtracting the amount of Ti forming TiN and TiS from the total amount of Ti to be added (shown by "Ti" in the equation (1)). When the thus obtained Ti* is equal to the left-hand side of the inequality (2) or 4 times of the C content, the Ti content in the equation (1) is the lower limit of the Ti content to be added.

As to carbon, it is necessary to restrict the carbon content to not more than 0.0060% in order to provide cold rolled steel sheets with an excellent press formability.

The reason why the contents of Ti and C are restricted as above is described in detail below.

Figure 1:
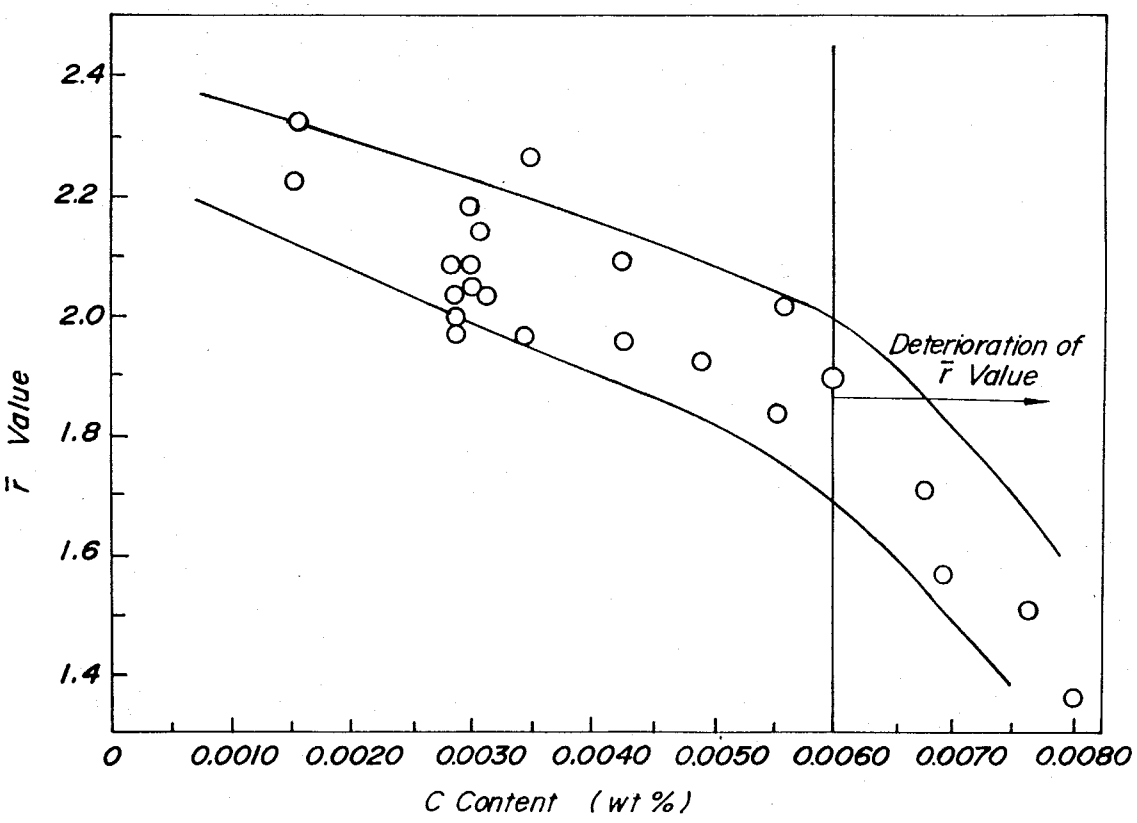
FIG. 1 is a graph showing the relation between the carbon content of the slab and the $\bar{r}$ value of the steel sheet product in case of $Ti^*/C \geqq 4.0$.

FIG. 1 is a graph showing the influence of the C content in the slab upon the $\bar{r}$ values of the steel sheet product in case of $Ti^*/C \geqq 4$. That is, FIG. 1 shows the relation between the C content of the slab and the $\bar{r}$ value of the steel sheet product when a steel material containing 0.0010–0.0080% of C, 0.05–0.09% of Mn, 0.010–0.012% of S, 0.0020–0.0040% of N, 0.030–0.050% of Al and 0.055–0.080% of Ti and satisfying Ti*/C of 4.0–19.5 was melted and cast into a slab, and the resulting slab was hot rolled under such conditions that the slab heating temperature is 1,000° C. and the hot finishing temperature is 750°–775° C., cold rolling at a draft of 78% and continuously annealed at 820° C. for 60 seconds. From this figure, it is understood that in case of $Ti^*/C \geqq 4.0$, when the carbon content is not more than 0.0060%, a very high $\bar{r}$ value of 1.8–2.4 is obtained even if the hot finishing temperature is not more than 780° C.

Figure 2:
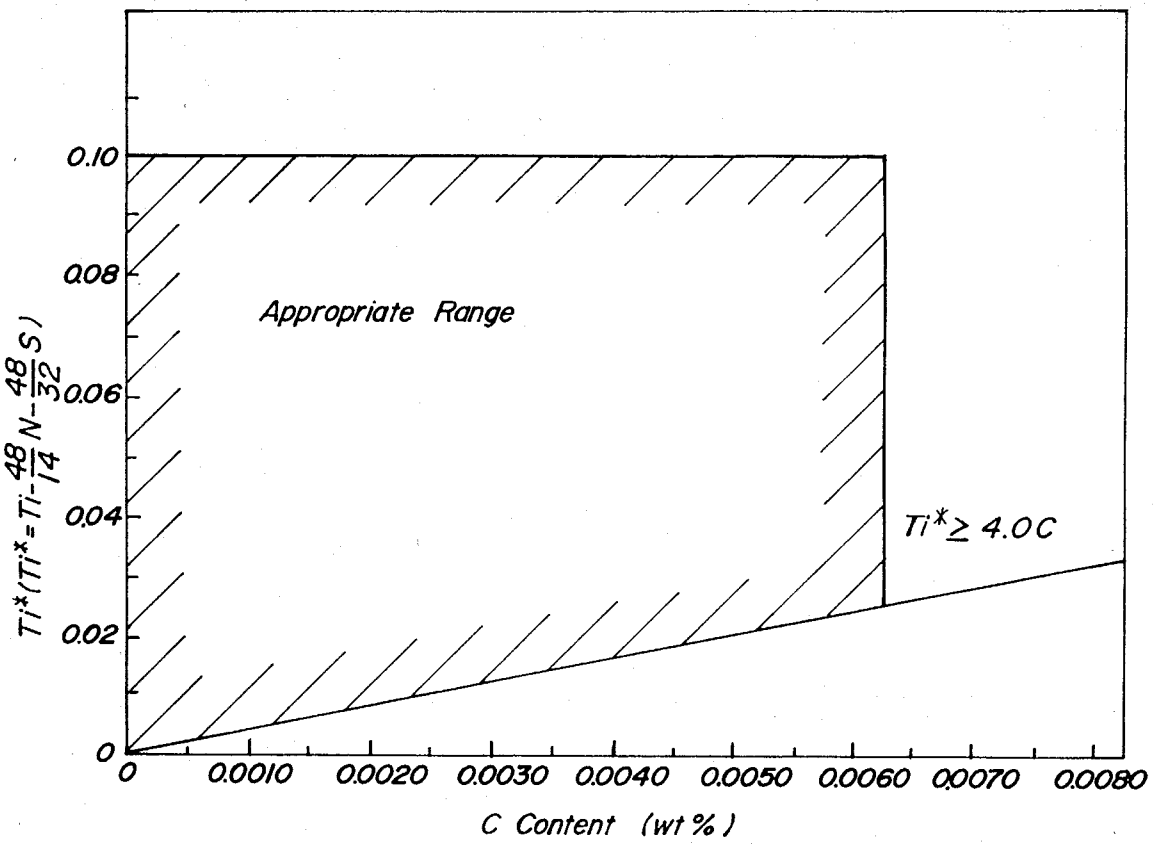
FIG. 2 is a graph showing an appropriate range in the relation between the carbon content and Ti* of the slab.

In FIG. 2 is shown the relation between the C content and the effective Ti content (Ti*) suitable for obtaining the excellent press formability. In FIG. 2, the shadowed region is an appropriate range in the relation between Ti* and C content.

Moreover, if Ti* exceeds 0.10%, the addition effect is no longer improved, and also the increased amount of Ti leads to increase the production cost. Thus, the upper limit of Ti* is 0.10%.

For the above reason, the C content is limited to not more than 0.0060%, while the Ti content is limited to not less than $(4.0 \times C)$% but not more than 0.10% in terms of Ti*.

Mn

Generally, Mn is an element lowering the $\bar{r}$ value of the steel sheet. Particularly, when the hot finishing temperature is not higher than $Ar_3$ transformation point, the deterioration of the $\bar{r}$ value is conspicuous. Accordingly, in order to prevent the deterioration of the $\bar{r}$ value when the hot finishing temperature is lower than $Ar_3$ transformation point, it is necessary to limit the C content to not more than 0.0060% and add Ti in an amount of corresponding to not less than four times of C as previously mentioned; and at the same time it is necessary to restrict Mn to less than 0.10%.

Although Mn is usually added in an amount of $Mn/S \geqq 10$ so as to prevent the hot brittle cracks due to S, the addition of Ti as defined in the invention causes no hot brittle crack because S is fixed in the form of TiS, so that it is not necessary to add Mn at the amount required for the prevention of hot brittle crack in the invention.

That is, the feature that steel sheets having $\bar{r}$ value required for the provision of the excellent press formability can be produced according to the invention even when the hot finishing temperature is not less than 780° C. is first realized by making the C content of the steel material lower and adding Ti to fix C in the form of TiC and at the same time fix S in the steel material in the form of TiS to thereby restrict the Mn content of the steel material as low as possible.

On the other hand, it is industrially difficult to remove Mn contained as an impurity element in the steel material up to less than 0.01%.

From the above reasons, Mn is restricted to a range of 0.01 to less than 0.10%.

Al

Al is added to deoxidize the steel material, but this element has no direct influence upon the improvement of the properties aimed at by the invention, and therefore its upper limit is set at 0.10% in view of the reduction of the cost. On the other hand, the lower limit is theoretically zero, but it is required to remain in an amount of about 0.005% so as to complete the deoxidation.

Cu, Ni, Cr

The steel sheet for automobile structural use is usually subjected to a treatment with zinc phosphate (chemical conversion treatment) prior to the coating. When the extremely low carbon, titanium-containing, steel sheet is subjected to the chemical conversion treatment, the crystal nuclei of zinc phosphate are scatteringly formed, which may come into problems depending on the chemical conversion treating conditions.

In order to solve such problems, Cu, Ni and Cr are further added alone or in combination according to the invention. Thus, the nuclei of zinc phosphate are densely precipitated onto the surface of the steel sheet to provide an excellent chemical conversion treating property. If the amount in total of Cu, Ni and Cr is smaller than 0.05%, no improvement effect on the chemical conversion treating property is obtained, while if it exceeds 0.2%, the quality of the steel sheet is deteriorated. Therefore, the amount in total of Cu, Ni and Cr is restricted to 0.05–0.20%.

Next, the invention will be described with respect to the hot rolling conditions.

Figure 3:
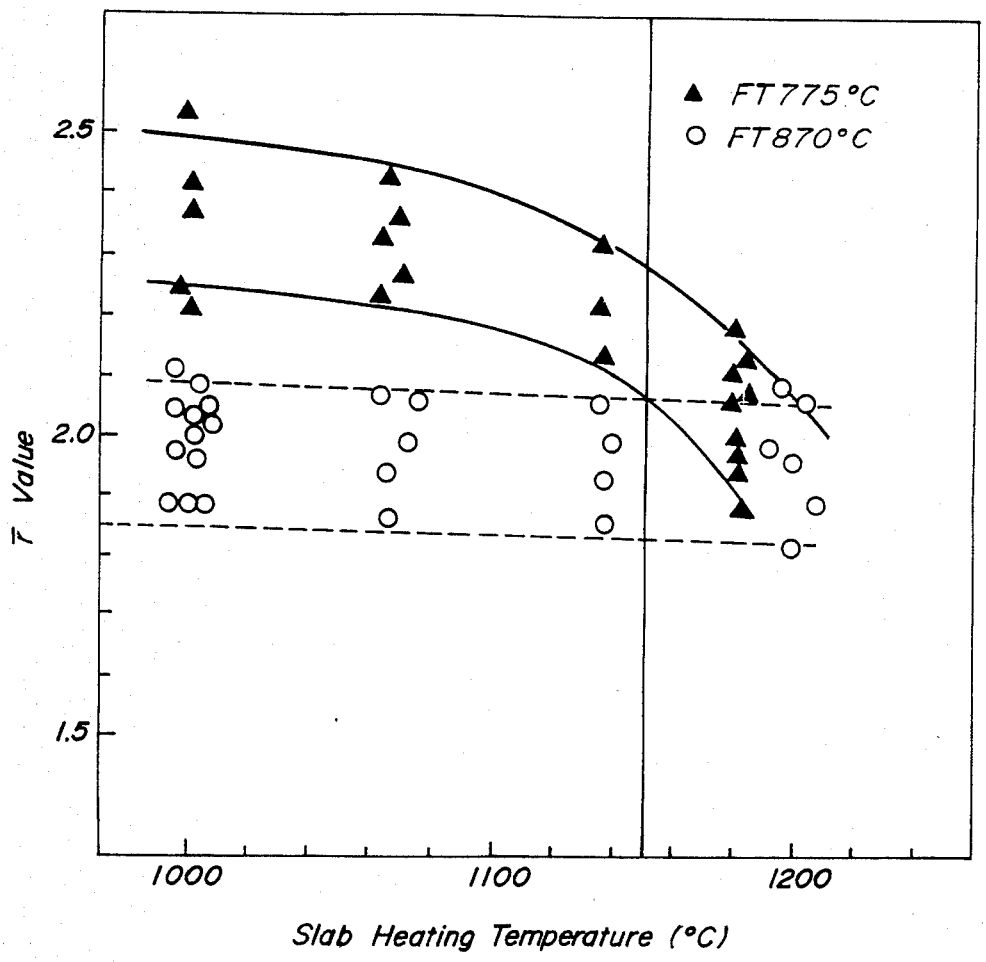
FIG. 3 is a graph showing the relation between the slab heating temperature and the $\bar{r}$ value of the steel sheet product.

FIG. 3 is a graph showing the influence of the change in the slab heating temperature upon the $\bar{r}$ value of the steel sheet product. That is, FIG. 3 shows the relation between the slab heating temperature and the $\bar{r}$ value of the steel sheets product when the slab containing 0.0015–0.0040% of C, 0.08% of Mn, 0.040–0.060% of Al and 0.055–0.065% of Ti and satisfying Ti*/C of 4.0–19.5 is heated in a reheating furnace by varying the slab heating temperature between 1,000°–1,200° C. and then hot rolled under such conditions that the hot finishing temperature (FT) is made to either of two levels of 775° C. and 870° C. and the coiling temperature is 550°–650° C.

As apparent from FIG. 3, when the hot finishing temperature (FT) is as high as 870° C., the improvement of $\bar{r}$ value is not observed even if the slab heating temperature is lowered from 1,200° C. to 1,000° C., while when FT is 775° C., the $\bar{r}$ value is remarkably improved if the slab is heated at a temperature of not more than 1,150° C. However, if the slab-heating temperature is less than 900° C., the deformation resistance in the hot rolling becomes higher, so that the hot rolling is impossible.

As mentioned above, when the slab is heated in the reheating furnace in order to increase the $\bar{r}$ value, the slab heating temperature is restricted to 900~1,150° C., and also the FT in the hot rolling is set at not more than 780° C.

On the other hand, according to the invention it is possible to directly hot roll the continuously cast slab (CC slab) without being passed through the reheating furnace. In general, when the CC slab is subjected to a direct hot rolling (DR), the temperature of such slab is low in the hot rolling, and hence FT is liable to be low. According to the invention, however, a high $\bar{r}$ value is obtained even if the FT is not more than 780° C. as mentioned above, so that the invention is most suitable for directly hot rolling the CC slab (i.e. CC-DR process). Thus, even if the invention is applied to CC-DR process without the reheating furnace, the FT is sufficient to be not more than 780° C.

The subsequent cold rolling is not required to take any special conditions and may be carried out in the usual manner.

Referring to the annealing conditions, no sufficient press formability can be obtained unless the annealing is carried out at a temperature higher than the recrystallization temperature, while if the cold rolled sheet is heated to a temperature for the formation of austenite exceeding 1,000° C., the $\bar{r}$ value of the steel sheet product is adversely affected. Therefore, the annealing is carried at a temperature of not less than the recrystallization temperature but not more than 1,000° C. for not less than 15 seconds.

The following examples are given in illustration of the invention and are not intended as limitations thereof.

EXAMPLE 1

Each of steel materials having a chemical composition as shown in the following Table 1, in which Run Nos. A and B are embodiments of the invention and Run Nos. C–F are comparative examples, was melted and continuously cast into a slab. The thus obtained slab was hot rolled to be 3.2 mm in thickness at hot rolling temperatures as shown in Table 1 and coiled at a coiling temperature of 600° C. Then, the hot rolled sheet was cold rolled to be 0.7 mm in thickness and subjected to a continuous annealing and a skin pass rolling at a rate of 0.4% to obtain a steel sheet product.

The quality of each of the thus obtained steel sheets was examined as follows:

Namely, test pieces of JIS No. 5 were prepared by cutting out each steel sheet at three angles of 0°(L), 45°(D) and 90°(C) with respect to the rolling direction, respectively, and the tensile test was made with respect to these test pieces. Thus, each of the yield strength, tensile strength, elongation, and $\bar{r}$ value were measured with respect to the test pieces in three directions L, C, D and an average value of (L+C2D)/4 was calculated from the measured values to evaluate the quality of the steel sheet.

Moreover, the unit consumption of fuel in the reheating furnace was also measure. The thus obtained results are shown in the following Table 2.

TABLE 1

| Run No | Chemical composition (wt %) (Ladle analysis) C | Si | Mn | P | S | Al | N | Ti | Ti* | Ti*/C | Hot rolling temperature: Slab heating temperature | Hot rolling temperature: Hot finishing temperature | Annealing conditions | Remarks |
|---|---|---|---|---|---|---|---|---|---|---|---|---|---|---|
| A | 0.0033 | 0.02 | 0.08 | 0.011 | 0.010 | 0.047 | 0.0030 | 0.061 | 0.036 | 10.91 | 1,000° C. | 775° C. | 30° C. × 40 sec. | |
| B | 0.0018 | " | " | " | " | 0.048 | 0.0020 | 0.058 | " | 20.0 | " | " | " | |
| C | 0.0078 | " | " | 0.012 | 0.011 | 0.050 | 0.0042 | 0.065 | 0.034 | 4.36 | " | 770° C. | " | Deviated carbon content |
| D | 0.0035 | " | 0.35 | " | " | 0.048 | 0.0029 | 0.062 | 0.036 | 10.3 | " | " | " | Deviated Mn upper limit |
| E | 0.0045 | " | 0.08 | " | 0.012 | 0.050 | 0.0030 | 0.040 | 0.011 | 2.6 | " | " | " | Deviated Ti* lower limit |
| F | 0.003 | " | " | " | 0.011 | 0.051 | 0.0029 | 0.062 | 0.036 | 11.9 | 1,250° C. | 875° C. | " | Deviated hot rolling temperature |

TABLE 2

| Run No. | Yield strength (kgf/mm²) | Tensile strength (kgf/mm²) | Elongation (%) | $\bar{r}$ value | Unit consumption of fuel in reheating furnace | Remarks |
|---|---|---|---|---|---|---|
| A | 14.0 | 27.5 | 51.5 | 2.41 | ◎ | |
| B | 13.5 | 27.3 | 52.3 | 2.51 | ◎ | |

TABLE 2-continued

| Run No. | Yield strength (kgf/mm²) | Tensile strength (kgf/mm²) | Elongation (%) | $\bar{r}$ value | Unit consumption of fuel in reheating furnace | Remarks |
|---|---|---|---|---|---|---|
| C | 20.2 | 31.5 | 45.8 | 1.51 | ⊙ | Poor quality |
| D | 19.8 | 31.0 | 46.2 | 1.54 | ⊙ | " |
| E | 22.3 | 32.1 | 43.3 | 1.45 | ⊙ | " |
| F | 15.4 | 29.0 | 50.0 | 1.90 | x | The unit consumption of fuel in the reheating furnace is poor |

⊙: Low slab heating temperature and good unit consumption of fuel
x: High slab heating temperature and poor unit consumption of fuel

EXAMPLE 2

A continuously cast slab was produced from molten steel having the chemical composition shown in Run No. B of Table 1 and directly hot rolled without being passed through the reheating furnace. As the hot rolling conditions, there were the hot finishing temperature of 725° C. and the coiling temperature of 675° C., and the thickness of the thus hot rolled sheet was 3.2 mm. The hot rolled sheet was cold rolled to be 0.7 mm in thickness, which was then subjected to a continuous annealing at 830° C. for 40 seconds and a skinpass rolling at a rate of 0.4% to obtain a steel sheet product.

The same tensile test as described in Example 1 was made with respect to the thus obtained steel sheet product to obtain results as shown in the following Table 3.

TABLE 3

| Yield strength (kgf/mm²) | Tensile strength (kgf/mm²) | Elongation (%) | $\bar{r}$ value |
|---|---|---|---|
| 14.0 | 27.5 | 52.3 | 2.45 |

As seen from the above, according to the invention, it is also possible to adopt the direct hot rolling system without the reheating furnace. Even in this case, it is possible to obtain the steel sheet having the same quality as in the slab-reheating system and also the unit consumption of fuel can be reduced largely.

EXAMPLE 3

A continuously cast slab was produced from molten steel having a chemical composition as shown in the following Table 4, wherein Run No. G is an embodiment of the invention and Run No. H is a comparative example, and then hot rolled to be 3.2 mm in thickness at a hot rolling temperature as shown in Table 4 and coiled at a coiling temperature of 600° C. The hot rolled sheet was cold rolled to be 0.7 mm in thickness and then subjected to a continuous annealing and a skin pass rolling at a rate of 0.4% to obtain a steel sheet product. The same tensile test as described in Example 1 was made with respect to the thus obtained steel sheet to obtain results as shown in the following Table 5.

In addition, the steel sheet was subjected to a chemical conversion treatment with zinc phosphate by spraying to obtain results as shown in Table 5.

TABLE 4

| Run No. | Chemical composition (wt %) (Ladle analysis) | | | | | | | | | | | | | Hot rolling temperature | |
|---|---|---|---|---|---|---|---|---|---|---|---|---|---|---|---|
| | C | Si | Mn | P | S | Al | N | Ti | Ti* | Ti*/C | Cu | Ni | Cr | Slab heating temperature | Hot finishing temperature |
| G | 0.0018 | 0.02 | 0.08 | 0.011 | 0.010 | 0.048 | 0.0020 | 0.058 | 0.036 | 20.0 | 0.08 | 0.04 | 0.04 | 1,000° C. | 775° C. |
| H | " | " | " | " | " | 0.050 | " | " | " | " | 0.01 | 0.01 | 0.02 | " | " |

TABLE 5

| Run No. | Yield strength (kgf/mm²) | Tensile strength (kgf/mm²) | Elongation (%) | $\bar{r}$ value | Amount of zinc phosphate deposited (g/m²) | Judgement on chemical conversion treating property |
|---|---|---|---|---|---|---|
| G | 14.0 | 27.8 | 52.1 | 2.45 | 2.49 | ⊙ |
| H | 13.5 | 27.3 | 52.3 | 2.51 | 1.55 | o |

⊙: Chemical conversion treating property is superior to that of the conventional box-annealed sheet.
o: Chemical conversion treating property is equal to that of the conventional box-annealed sheet.

From Table 5, it is understood that the steel sheet obtained from the steel material containing such an amount of Cu, Ni and Ni as defined in the invention has mechanical properties equal to that of the steel sheet obtained from the steel material containing such elements at amounts outside the defined range of the invention and has more excellent chemical conversion treating property.

What is claimed is:

1. A method of manufacturing cold rolled steel sheets for extra deep drawing with an excellent press formability, which comprises the steps of:

melting a steel material containing not more than 0.0060% by weight of C, 0.01 to less than 0.10% by weight of Mn, 0.005–0.10% by weight of Al and Ti corresponding to Ti(%) represented by the following equation (1) when an effective Ti amount expressed by Ti* in the equation (1) satisfies the following ineqality (2);

continuously casting the resulting molten steel to produce a cast slab;

hot rolling the resulting cast slab immediately or after the slab is heated at a temperature of 900°–1,150° C., during which a hot finishing temperature is made to a temperature of not more than 780° C.;

cold rolling the resulting hot rolled sheet in the usual manner; and subjecting the resulting cold rolled sheet to a recrystallization annealing at a temperature of not less than the recrystallization temperature but not more than 1,000° C.;

$$Ti^*(\%)=Ti(\%)-(48/14)N(\%)-(48/32)S(\%) \quad (1)$$

$$4.0\times C(\%)\leqq Ti^*(\%)\leqq 0.10 \quad (2)$$

whereby the resulting cold rolled sheet has an $\bar{r}$ value of $\geqq 2.0$.

2. A method of manufacturing cold rolled steel sheets for extra deep drawing with excellent press formability and chemical conversion treating property, which comprises the steps of:

melting a steel material containing not more than 0.0060% by weight of C, 0.01 to less than 0.10% by weight of Mn, 0.005–0.10% by weight of Al, Ti corresponding to Ti(%) represented by the following equation (1) when an effective Ti amount expressed by Ti* in the equation (1) satisfies the following inequality (2) and 0.05~0.20% by weight in total of at least element of Cu, Ni and Cr;

continuously casting the resulting molten steel to produce a cast slab;

hot rolling the resulting cast slab immediately or after the slab is heated at a temperature of 900°–1,150° C., during which a hot finishing temperature is made to a temperature of not more than 780° C.;

cold rolling the resulting hot rolled sheet in the usual manner; and subjecting the resulting cold rolled sheet to a recrystallization annealing at a temperature of not less than the recrystallization temperature but not more than 1,000° C.;

$$Ti^*(\%)=Ti(\%)-(48/14)N(\%)-(48/32)S(\%) \quad (1)$$

$$4.0\times C(\%)\leqq Ti^*(\%)\leqq 0.10 \quad (2)$$

whereby the resulting cold rolled sheet has an $\bar{r}$ value of $\geqq 2.0$.

* * * * *